US006036462A

United States Patent [19]

Mallen

[11] Patent Number: 6,036,462

[45] Date of Patent: Mar. 14, 2000

[54] ROTARY-LINEAR VANE GUIDANCE IN A ROTARY VANE MACHINE

[75] Inventor: Brian D. Mallen, Charlottesville, Va.

[73] Assignee: Mallen Research Ltd. Partnership, Charlottesville, Va.

[21] Appl. No.: 08/887,304

[22] Filed: Jul. 2, 1997

[51] Int. Cl.[7] ..... F01C 1/344

[52] U.S. Cl. ..... 418/150; 418/235; 418/265

[58] Field of Search ..... 418/235, 253, 418/257, 265, 150

[56] References Cited

U.S. PATENT DOCUMENTS

| | | | |
|---|---|---|---|
| Re. 29,230 | 5/1977 | Sarich | 418/61.1 |
| 1,488,729 | 4/1924 | Ballay | 418/265 |
| 1,743,539 | 1/1930 | Gasal | 418/265 |
| 2,536,938 | 1/1951 | Hunter | 418/265 |
| 3,053,438 | 9/1962 | Meyer | 418/235 |
| 3,101,076 | 8/1963 | Stephens-Castaneda | 418/265 |
| 3,771,902 | 11/1973 | Bandy | 418/253 |
| 4,021,160 | 5/1977 | Todorovic | 418/61.1 |
| 4,037,997 | 7/1977 | Sarich | 418/61.1 |
| 4,079,083 | 3/1978 | Sarich | 418/61.1 |
| 5,501,586 | 3/1996 | Edwards | 418/265 |
| 5,524,586 | 6/1996 | Mallen | 123/219 |
| 5,524,587 | 6/1996 | Mallen et al. | 123/243 |

FOREIGN PATENT DOCUMENTS

| | | | |
|---|---|---|---|
| 361866 | 10/1922 | Germany | 418/265 |
| 430365 | 6/1935 | United Kingdom | 418/265 |

*Primary Examiner*—John J. Vrablik
*Attorney, Agent, or Firm*—Jones Volentine, LLP

[57] ABSTRACT

A rotary vane machine having a rotary-linear vane guidance structure, including a translation ring disposed at each axial end of the machine, the translation ring rotating around a fixed hub, with the fixed hub being eccentric to a rotor shaft axis, with the rotor spinning around the rotor shaft axis which is a fixed rotational axis relative to a stator cavity. A plurality of vanes are disposed in a corresponding plurality of vane slots in the rotor, each of the vanes having a tip portion and a base portion, with the base portion having a protruding tab extending from each axial end therefrom. A plurality of linear channels are formed in each translation ring, wherein the protruding tabs extending from the base portion of each of the plurality of vanes communicate with a respective linear channel in the translation ring, whereby the rotor rotation causes rotation of the vanes and a corresponding rotation of the translation ring. The stator cavity has a contoured sealing profile determined from a continuous path traced by the tips of the vanes as the rotor spins around the rotor shaft axis and the translation ring rotates around the eccentric fixed hub, thereby creating cascading cells of compression and expansion between the rotor, the vanes, and the stator cavity as the vanes sweep by the contoured profile of the stator cavity.

36 Claims, 11 Drawing Sheets

ROTARY-LINEAR VANE GUIDANCE IN A ROTARY VANE MACHINE

BACKGROUND OF THE INVENTION

1. Field of the Invention

The present invention generally relates to rotary vane machines, and more particularly, to an apparatus providing for rotary-linear vane guidance in a rotary vane pumping machine.

DESCRIPTION OF THE RELATED ART

The overall invention relates to a large class of devices comprising all rotary-vane (or sliding vane) pumps, compressors, engines, vacuum-pumps, blowers, and internal combustion engines.

This class of devices includes designs having a rotor with slots with a radial component of alignment with respect to the rotor's axis of rotation, vanes which reciprocate within these slots, and a chamber contour within which the vane tips trace their path as they rotate and reciprocate within their rotor slots. The reciprocating vanes thus extend and retract synchronously with the relative rotation of the rotor and the shape of the chamber surface in such a way as to create cascading cells of compression and/or expansion, thereby providing the essential components of a vane machine. Some means of radially guiding the vanes must therefore be provided to ensure contact, or close proximity, between the vane tips and chamber surface as the rotor and vanes rotate with respect to the chamber surface.

With conventional designs, this radial guidance of the vanes has been provided by a number of means which necessitate undesirable high-speed frictional motion. One common means of guidance utilizes the tips of the vanes as a sliding frictional interface against the chamber contour. With this means employed, inertial and/or fluid forces push the vanes against the chamber surface to provide adequate sealing. Another means utilizes a pin at one or both ends of the vanes, each pin riding within a channel or against a cam to provide guidance of the vanes. Floating followers may be employed around the pins to provide a hydrodynamic wedge against the cam surface. Alternatively, the device may be configured such that one or more sleeve or cam follower bearings are employed around each pin to provide a rolling interface against the cam.

These conventional means of guiding the vanes all suffer from a common shortcoming, namely that high linear speeds are encountered at the radial-guidance frictional interface. These high speeds severely limit the maximum speed of operation and thus the maximum flow per given engine size. Furthermore, the maximum inertial and/or fluid-pressure forces which can be resisted by the frictional interface is limited. In the case of a hydrodynamic interface, the high heat-flux and shearing rate involved limit the maximum force and speed and the viscosity of lubricant which can be employed. The hydrodynamic interface also limits the precision of the radial vane guidance that may be obtained, as sufficient clearance must be provided for the hydrodynamic oil film. In the case of the cam follower bearings, the maximum size of the cam follower is limited by many factors including the size of the device, the speed of rotation, and the angular acceleration torques produced as the radial position of the vanes change throughout their cycle of rotation. The cam follower size limitation limits the maximum force the followers can resist. The high speeds involved combined with the high angular acceleration torques on the cam followers can produce significant power losses, heat buildup, and/or wear. These above limitations severely reduce the potential effectiveness of the vane device.

However, several advantages are evident in the sliding-vane geometry as in the present invention. One such advantage is that cascading cells of compression and/or expansion are created as the vanes sweep by the chamber surfaces, thereby forming multi-stage sealing which improves sealing efficiency.

Another advantage of this basic geometry is that the chamber surface is significantly steady-state with respect to temperature and pressure, provided sufficient vane stages are employed. In other words, the region of the cycle, temperatures, and pressures "seen" by the chamber surface at a given location do not change significantly as the vanes sweep by. This characteristic contrasts with the significantly non-steady-state quality of a cylinder wall of a piston machine, wherein locations on the cylinder wall experience drastic changes in pressure and temperature throughout the cycle. Because of this steady-state component within the chamber surfaces of this sliding-vane geometry, specific regions of the cycle can be targeted or accessed simply by selecting a site on the chamber surface. For instance, a combustion residence chamber within an internal combustion engine embodiment can be employed to enhance lean combustion characteristics as described in U.S. Pat. Nos. 5,524,586 to Mallen and 5,524,587 to Mallen et al.

This steady-state component and sweeping vane arrangement has certain advantages compared with a piston engine or orbital designs, such as those shown in U.S. Pat. Nos. 4,021,160; 4,037,997; 4,079,083; and Re. 29,230.

One advantage is the ability to place large, continuously-open intake and exhaust scavenging ports in the engine, such ports not requiring complex valves or valve trains for their timing. Another is that this steady-state component can also serve to boost thermal efficiency by reducing the chamber wall heat-flux from the hotter regions of the cycle.

The steady-state component of the chamber surfaces thus offers many potential advantages to designers of engines or pumping machines by virtue of the ability to easily and efficiently access different parts of the device's cycle without requiring valves or other complex means to do so.

In light of the foregoing, there exists a need for a sliding-vane geometry, wherein multiple vanes sweep in relative motion against the chamber surfaces, which incorporates a radial-guidance frictional interface operating at a reduced speed compared with the tangential speed of the vanes at the radial location of the interface. This interface should furthermore permit higher loads at high rotor rotational speeds to be sustained by the bearing surfaces than with conventional designs. With such an improved design, much higher flow rates could be achieved within a given size pumping device or internal combustion engine, thereby improving the performance and usefulness of these machines.

SUMMARY OF THE INVENTION

Accordingly, the present invention is directed to a rotary vane machine that substantially overcomes one or more of the problems due to the limitations and disadvantages of the related art.

In the present invention, an engine geometry is employed utilizing reciprocating vanes which extend and retract synchronously with the relative rotation of the rotor and the shape of the chamber surface in such a way as to create cascading cells of compression and/or expansion, thereby providing the essential components of a vane machine.

More specifically, the present invention provides a means for rotary-linear vane guidance in rotary vane machines. In one embodiment, a translation ring at each axial end of the machine spins freely around a fixed hub. This fixed hub is eccentric to a rotor shaft axis. The base portion of the vanes have rectangular tabs protruding from both axial ends, with each tab riding within a respective linear channel of the translation ring. The vanes are constrained to radial motion within the rotor slots by vane-slot rollers or by a sliding frictional interface.

With this arrangement, the rotation of the rotor and translation rings automatically sets the radial position of the vanes at any rotor angle, producing a single contoured path as traced by the vane tips, resulting in a unique near-circular stator cavity shape that mimics and seals the path the vane sealing tips trace.

The vane tabs within the linear channels of the translation rings automatically set the translation rings in rotation at a fixed angular velocity identical to the angular velocity of the rotor. Therefore, the translation ring does not undergo any significant angular acceleration at a given rotor rpm. Furthermore, no gearing is needed to maintain the proper angular position of the translation rings because this function is automatically performed by the geometrical combination of the tabs within the linear channels of the translation rings, the vanes within the rotor slots, the rotor about its shaft axis, and the translation ring hub about its offset axis.

It is important for high speed rotating machinery to recover quickly and firmly from an offset or out-of-balance situation in order to provide dynamic stability. In the case of the described translation rings, tight bearings will provide the necessary dynamic stability. Furthermore, a desirable feature of this geometry is that the torque arm of the vane tabs against their translation channels will automatically reduce or increase in proper response to the translation ring being ahead or behind its proper angular position, thereby automatically providing increased centering control.

Yet another advantage of this geometry is that opposing vanes largely offset each other's inertial load affecting the main bearing of the translation ring within the end plate. Thus, the inertial load sustained or countered by the main bearing of the translation ring hub is a fraction of the total inertial load of all the vanes. The large main-bearing surface area combined with this inertial-balancing effect permits the main bearing to sustain very high vane inertial loads at high rotational speeds. High speed bearing designs may be employed within this main bearing to further increase the useful rotational speed. Higher rotational speeds with minimal friction translate into increase flow or power for a given engine size, and increased sealing and thermal efficiency.

The linear channels may contain rollers which provide a rolling interface between the vane tabs and the linear channel walls, thereby reducing friction and the need for lubricant and permitting tighter sealing tolerances. Each set of linear channel rollers may be contained within a cage which keeps the rollers in the correct position while not in contact with the vane tabs.

To achieve these and other advantages and in accordance with the purpose of the invention, as embodied and broadly described, the invention provides for a rotary vane machine having a stator cavity communicating with a rotor, the rotor spinning around a rotor shaft axis which is a fixed rotational axis relative to the stator cavity, comprising: a plurality of vanes disposed in a corresponding plurality of vane slots in the rotor, each of the vanes having a tip portion and a base portion, the base portion having a protruding tab extending from each axial end therefrom; a means for vane guidance comprising a translation ring disposed at one axial end of the vane machine, the translation ring rotating around a fixed hub located within an end plate of the machine, the fixed hub being eccentric to the rotor shaft axis; and a plurality of linear channels formed in the translation ring, wherein the protruding tabs extending from the base portion of each of the plurality of vanes communicate with a respective linear channel in the translation ring, whereby the rotor rotation causes rotation of the vanes and a corresponding rotation of the translation ring, the stator cavity having a contoured sealing profile determined from a continuous path traced by the tips of the vanes as the rotor spins around the rotor shaft axis and the translation ring rotates around the eccentric fixed hub, thereby creating cascading cells of compression and expansion between the rotor, the vanes, and the stator cavity as the vanes sweep by the contoured profile of the stator cavity.

BRIEF DESCRIPTION OF THE DRAWINGS

The foregoing and other objects, aspects, and advantages will be better understood from the following detailed description of the embodiments of the invention with reference to the drawings, some dimensions of which have been exaggerated and distorted to better illustrate the features of the invention, and with like reference numerals being used for like and corresponding parts of the various drawings, in which.

DETAILED DESCRIPTION OF THE INVENTION

Reference will now be made in detail to an embodiment of a rotary machine incorporating a means for rotary-linear vane guidance, an example of which is illustrated in the accompanying drawings. The embodiment described below may be incorporated in all rotary-vane or sliding vane pumps, compressors, engines, vacuum-pumps, blowers, and internal combustion engines.

Figure 1:
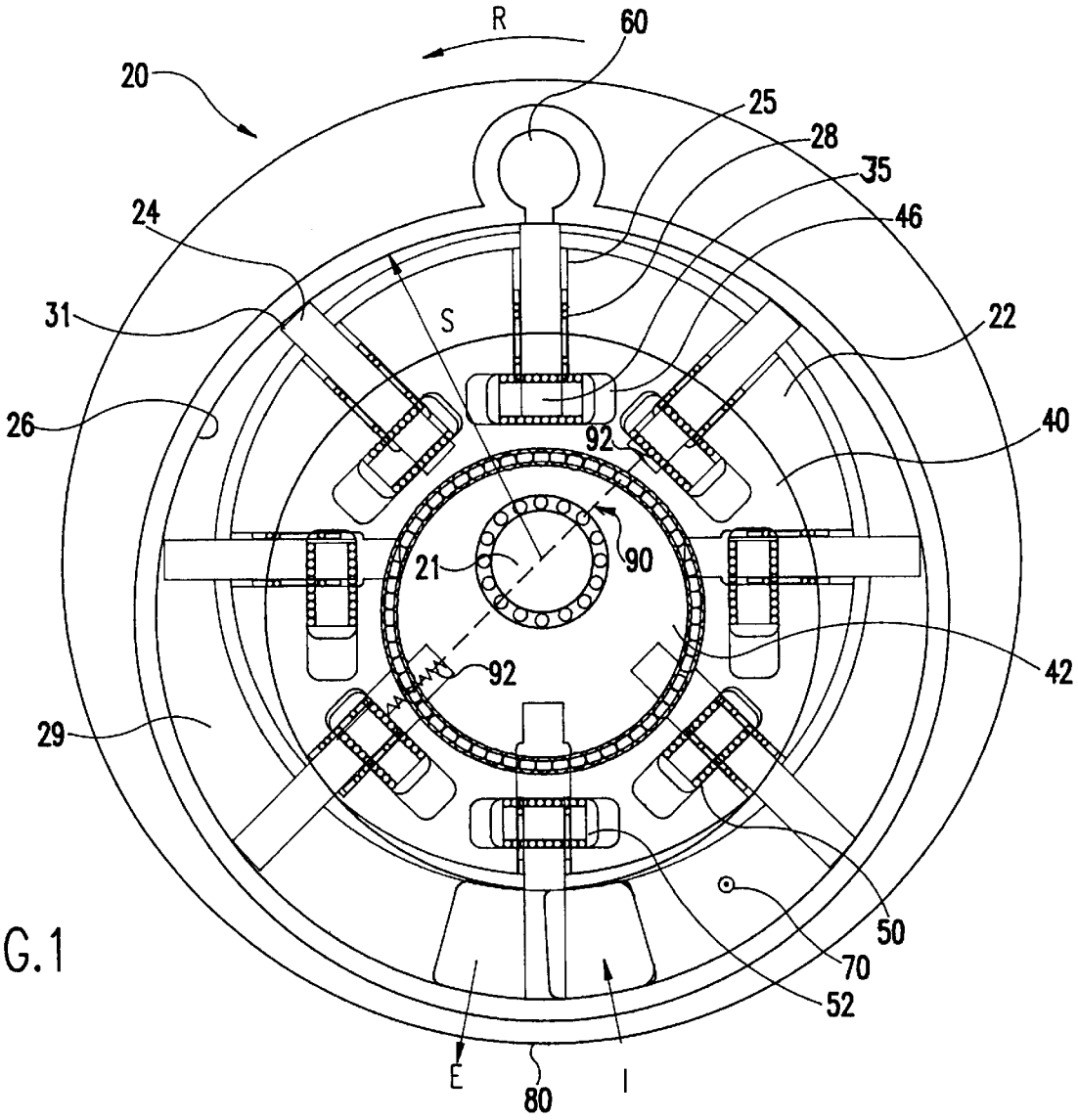
FIG. 1 is a side cross sectional view of a rotary-vane machine in accordance with the present invention.

An exemplary embodiment of the means for rotary-linear vane guidance in a rotary machine is shown in FIG. 1 and is designated generally as reference numeral 20. The apparatus contains a rotor 22, with rotor and rotor shaft 21 rotating about the rotor shaft 21 axis in a counterclockwise direction as shown by arrow R in FIG. 1. The rotor 22 may also rotate in a clockwise direction. The rotor shaft has a fixed rotational axis relative to a stator cavity 26. The rotor 22 houses a plurality of vanes 24 in vane slots 25, wherein each pair of adjacent vanes 24 defines a vane cell 29. The contoured stator cavity 26 forms the roughly circular shape of the chamber outer surface. As used herein, the stator cavity comprises not only the contoured cavity portion but also the sealing end walls at both axial ends of the machine. The end plates 44 shown in FIG. 10 may serve as the stator cavity end walls for the machine.

Figure 3A:
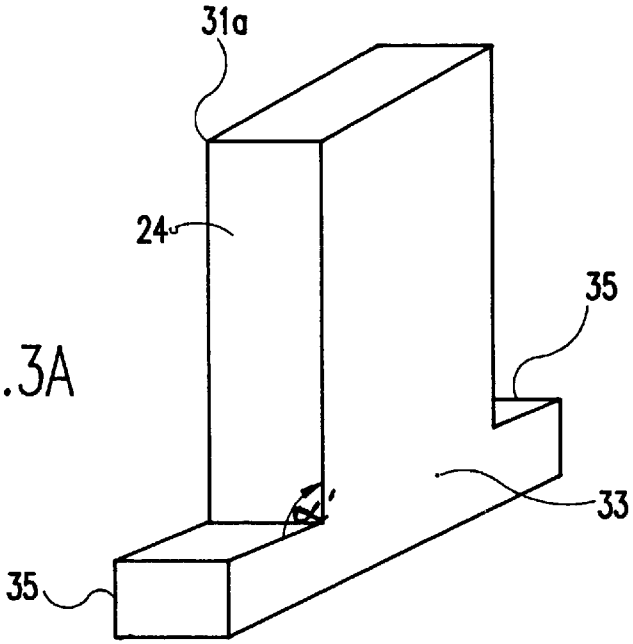
FIG. 3A is a perspective view of one embodiment of the vane employed in the present invention.

Each of said vanes 24 has a tip portion 31 and a base portion 33, with the base portion having a protruding tab 35 extending from each axial end therefrom as shown in FIG. 3A. While the tip portion 31*a* of the vane in FIG. 3A is rectangular, the invention is not limited to such a design, it being understood that the vane tip portion may take on many shapes within the scope of the invention, for example, the triangular shape vane tip 31*b* depicted in FIG. 3B. The tip portion may contain one or more sealing tips. As an example, the triangular shape vane tip 31B in FIG. 3B would provide a single sealing tip at the tip portion, whereas the rectangular tip portion 31A in FIG. 3A would provide two sealing tips. The multiple sealing tips of a vane need not all contact the stator contour at the same time. The sealing tip or tips need not be symmetrical with respect to the vane centerline.

The base portion 33 of the vane and the protruding tabs 35 extending therefrom may be formed at approximately a right angle $\alpha'$ as shown in FIG. 3A. The angle a may alternatively be formed at other angles provided the angle permits alignment with the linear channel. Angles other than 90 degrees, however, may impart an axial component of load on the translation ring (discussed below) which may be undesirable in certain embodiments. The junction 34*a* may be filleted as shown in FIG. 3D. The end portions 34*b* of the tab 35 may be curved as well, as shown in FIGS. 3C, 3D and 3E. Also, the protruding tab 35 need not be located at the very bottom of the vane. One or more tabs may be at one or both axial ends of each vane, each tab riding within, upon, or against a linear channel (discussed below). The width tangential to the rotor of the tab upper and lower surfaces need not be identical. For example, a trapezoidal shape could be employed with the lower tabs utilizing a smaller width. Such an embodiment would permit more vanes to be employed within the rotor while maintaining sufficient room for the channels. FIG. 3G illustrates an example of such a trapezoidal vane tab embodiment.

Figure 2:
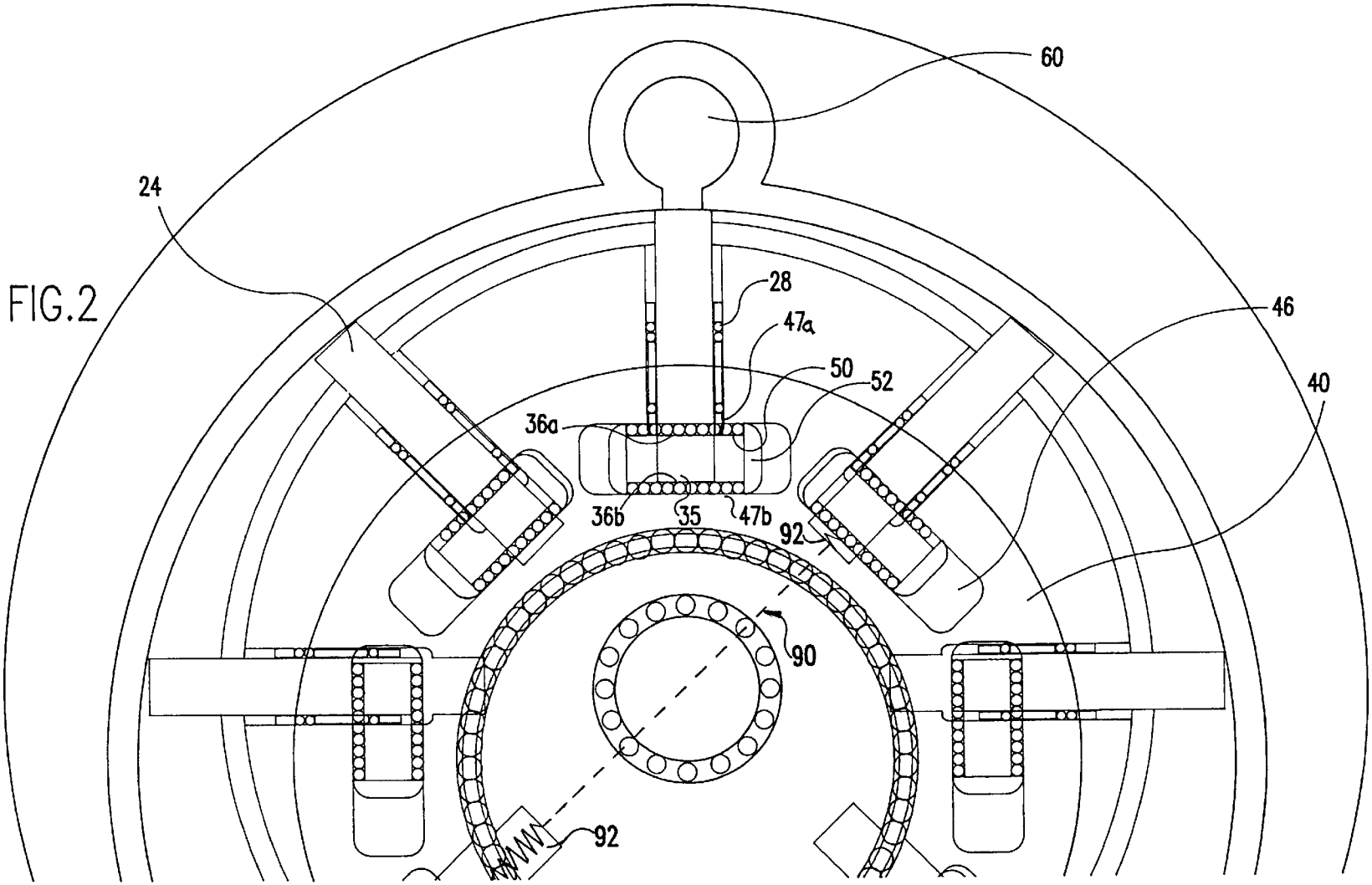
FIG. 2 is an enlarged view of an upper portion of FIG. 1.

The vanes are constrained to radial motion within the rotor slots 25 by vane-slot rollers 28 as shown best in FIG. 2. Herein, radial motion means any motion incorporating a radial component. The vane's shape and motion may incorporate any offset, diagonal, angular, or arcuate component, provided the radial component of motion is present and provided the geometry works in accordance with the translation ring channel geometry. The important element of the constrained motion within the rotor slots is that a means be employed to prevent significant wobble of the vanes within their rotor slots. Alternative means to that illustrated may be employed, such as a simple sliding frictional interface without roller bearings. Such means for constraining the motion of the vanes within their rotor slots plays a role in guiding the vanes within the present invention, as is further detailed below.

Figure 10:
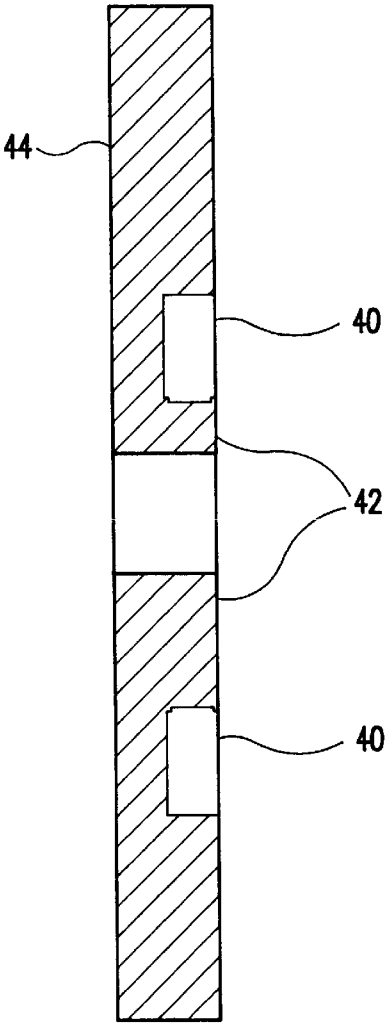
FIG. 10 is a cross sectional view of an end plate of a vane machine showing the linear translation ring and fixed hub.

As shown in FIGS. 1 and 10, a translation ring 40 is disposed at each axial end of the rotary machine 20. The translation ring 40 spins freely around a fixed hub 42 located in the end plate 44 of the machine 20, with the fixed hub 42 being eccentric to the axis of rotor shaft 21. The translation ring 40 may spin around its hub 42 utilizing any type of bearing at the hub-ring interface including for example, a journal bearing of any type and an anti-friction rolling bearing of any type. As shown in greater detailed in FIG. 2, the translation ring 40 contains a plurality of linear channels 46. The linear channels 46 allow the vanes to move linearly as the translation ring 40 rotates around the fixed hub 42.

In operation, the pair of protruding tabs 35, extending from the base portion 33 of each of the plurality of vanes 24, communicate with a respective linear channel 46 in the translation ring. That is, one protruding tab 35 communicates with a linear channel 46 in the translation ring 40 located at one axial end of the machine, and the other protruding tab 35 communicates with a linear channel 46 in the translation ring 40 located at the other axial end of the machine.

Though the machine 20 could operate successfully with the tabs 35 on only one side of the vanes 24 and communicating with only one translation ring 40, the best performance is obtained by the balanced, two-ended arrangement described above, namely, a translation ring 40 located at each axial end of the machine 20. More than one tab 35 and linear channel 46 could be provided at each axial end of the vanes to increase bearing surface area, though available space would limit the practical potential for such an arrangement. The tabs at each axial end need not extend from the vanes at the same height on the vanes, nor need their shapes be the same.

In operation, the rotor 22 rotation causes rotation of the vanes 24 and a corresponding rotation of each translation ring 40. The protruding vane tabs 35 within the linear channels 46 of the translation rings 40 automatically set the translation rings 40 in rotation at a fixed angular velocity identical to the angular velocity of the rotor 22. Therefore, the translation ring 40 does not undergo any significant angular acceleration at a given rotor rpm.

Also, the rotation of the rotor 22 in conjunction with the translation rings automatically sets the radial position of the vanes at any rotor angle, producing a single contoured path as traced by the vane tips (31*a* or 31*b*) resulting in a unique stator cavity 26 shape that mimics and seals the path the vane tips trace. The parameters of the contoured stator cavity are described later in the specification.

No gearing is needed to maintain the proper angular position of the translation rings 40 because this function is automatically performed by the geometrical combination of the tabs within the linear channels 46 of the translation rings 40, the vanes 24 constrained to radial motion within their rotor slots 25, the rotor 22 about its shaft 21 axis, and the translation ring hub 42 about its offset axis.

Figure 3B:
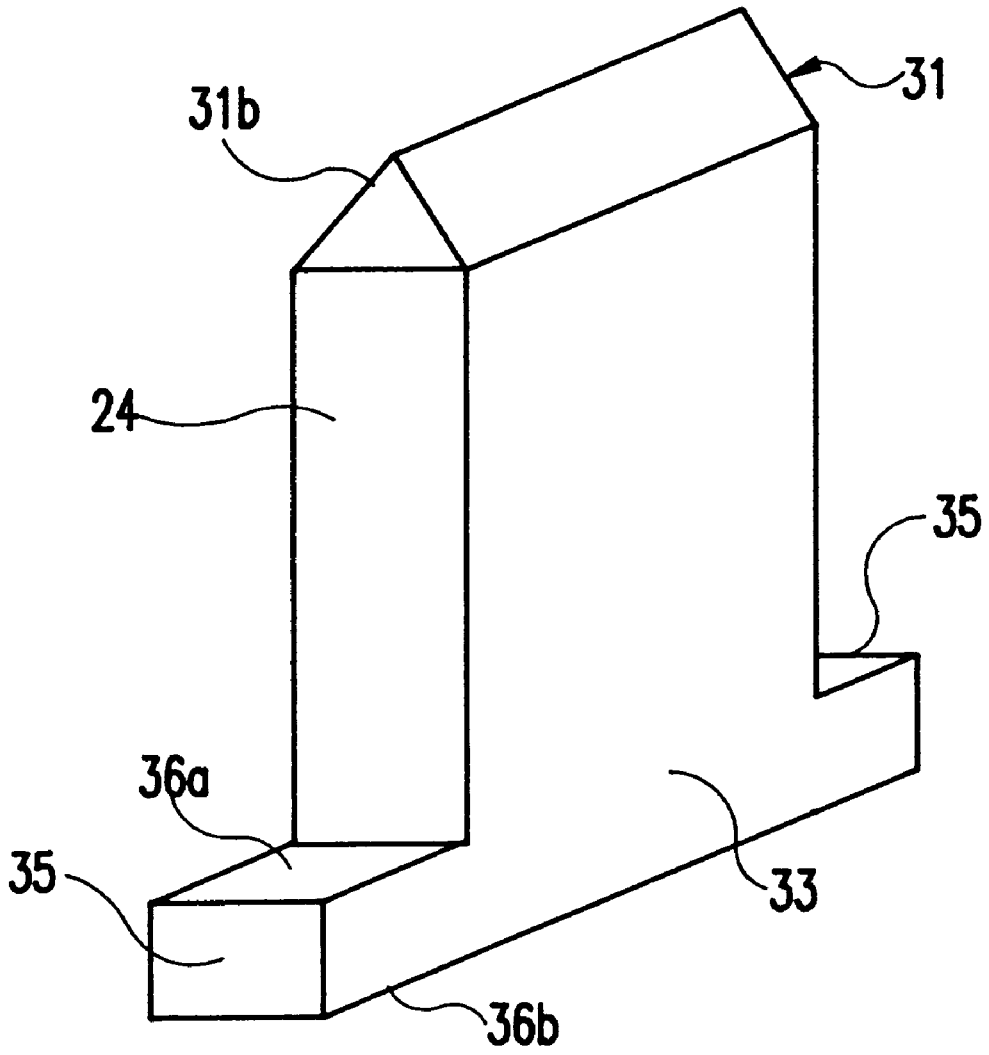
FIG. 3B is perspective view of another embodiment of the vane employed in the present invention.

Referring to FIGS. 2 and 3B, although only the upper 36*a* or only the lower 36*b* surfaces of the tabs 35 may communicate with the linear channels 46 in certain embodiments, it is preferable in many applications to have both surfaces constrained within the linear channels 46 so as to ensure proper alignment of the translation rings 40 and thus the radial position of the vanes 24.

Note that if only the lower tab surface 36*b* is used to communicate with the linear channel 46, there need not necessarily be a protruding tab 35, since the bottom surface of the vane 24 itself may serve the function of the lower tab surface. The linear channel 46 need not be recessed in such a case, but may actually protrude from the linear translation ring 40.

Various vane shapes are possible which provide at least one of an upper and lower bearing surface to work in communication with the linear surfaces of the linear translation ring and in accordance with the present invention. All such shapes must provide radial guidance to the vanes via means of a linear-translation ring with linear surfaces communicating with the appropriate vane surfaces.

As used herein, the term protruding tabs 35 incorporates any means for providing a surface which is part of, or connected to, the vane 24 which can provide bearing support against the linear translation ring 40. Again, the bottom surface of the vane may in certain embodiments serve this function with or without any end protrusions. As used herein, linear channels 46 means any flat surface or surfaces on, connected to, or within the translation ring which can provide bearing support against the vane tab bearing surface or surfaces, with the possible imposition of a rolling interface between the vane tab and linear channel flat surfaces.

The linear channels 46 are not exposed to the engine chamber and can thus be lubricated with, for example, oil, oil mist, dry film, grease, fuel, fuel vapor or mist, or combination thereof, without encountering major lubricant contamination problems.

As shown in FIG. 2, the linear channels 46 may contain rollers 50 which provide a rolling interface between the vane tabs 35 and the linear channel walls, thereby reducing friction and the need for lubricant and permitting a tighter control over the radial positioning of the vanes. The rollers 50 may communicate with at least one of the upper and/or lower flat surfaces 36*a* and 36*b* of the vane protruding tabs 35 (see FIG. 3B). As shown in FIG. 2, the rollers 50 are shown disposed in two rows, each row being located between the respective upper 36*a* and lower 36*b* surfaces of the vane protruding tabs 35 and upper 47*a* and lower 47*b* walls of the linear channel.

Figure 4:
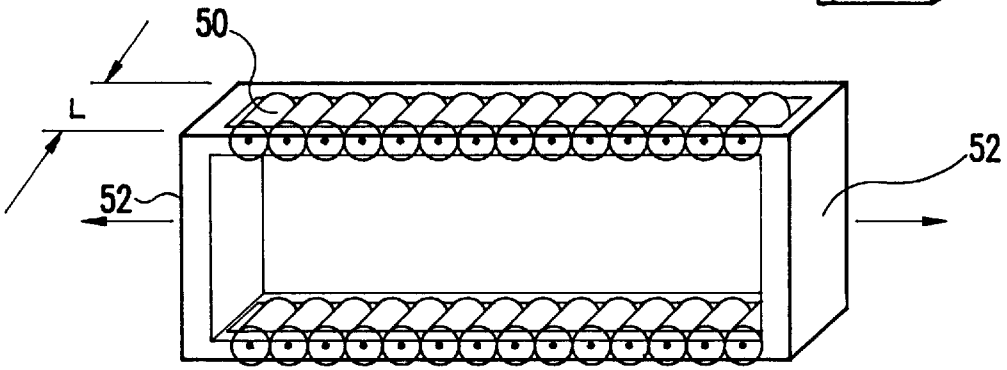
FIG. 4 is a perspective view of the rollers housed in one embodiment of a roller cage according to the present invention.

The length L of the rollers 50 may be varied and need not be the same between the upper and lower rollers. As shown in FIG. 4, each of the rollers 50 is cylindrical, and the length L of the cylindrical roller is at least the same as a length of the flat surfaces 36*a* or 36*b* of the protruding tab 35. Alternatively, the length L of the cylindrical roller 50 may be less than the length of the flat surfaces 36*a* or 36*b* of the protruding tab 35. The axial length of the upper 47*a* and lower 47*b* walls of the linear channel may be greater than, less than, or equal to the axial length of the linear translation ring 40. It is understood that the roller 50 need not be cylindrical, and may take on various other shapes, for example, spherical or contoured, within the scope of the present invention.

FIG. 4 also shows a perspective view of one embodiment of a means for restraining the rollers 50 in the linear channel 46. In the embodiment shown in FIG. 4, the restraining means comprises a roller cage 52 arranged within each of the plurality of linear channels 46 to house the plurality of rollers 50. Each set, that is, two rows, of linear channel rollers 50 are contained within the cage 52 which keeps the rollers 50 in proper radial, azimuthal, and axial position while not in contact with the vane tabs 35.

Figure 7:
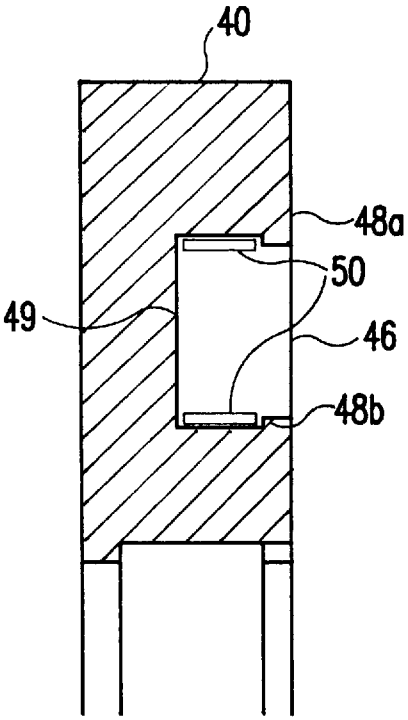
FIG. 7 is a cross section view of a portion of the linear translation ring.
Figure 5:
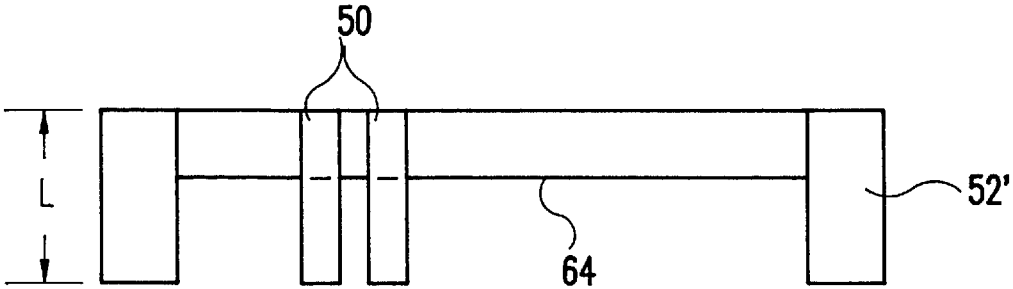
FIG. 5 is a top view of the rollers housed in a second embodiment of a roller cage according to the present invention.
Figure 6:
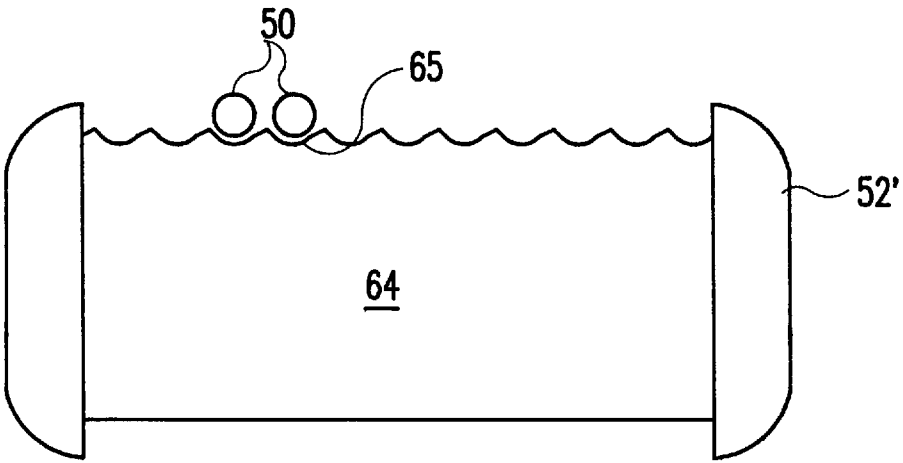
FIG. 6 is a front view of the rollers and roller cage in FIG. 5.

FIGS. 5 and 6 illustrate top and front views of the rollers 50 communicating with another embodiment of the roller cages 52'. In this embodiment, the cage 52' restrains the radial and azimuthal location of the rollers and the axial restraint is provided by the translation channels rear wall 49 and front lips 48*a* and 48*b* as shown in the cross-section of FIG. 7, which is a cross sectional view of a portion of the translation ring 40. The rear wall 49 also beneficially serves to stiffen the translation ring. Specifically, each of the linear channels 46 contain upper and lower extending lip portions 48*a* and 48*b* at the axial interface with the rotor 22. The extending lip portions 48*a* and 48*b* retain the rollers 50 axially. Note that the cage 52' is not shown in FIG. 7. However, if the cage 52' were disposed in the linear channel 46, the protruding vane tab 35 would contact a rear wall 64 (see FIGS. 5 and 6) of the cages 52' to axially retain the cages 52' within the linear channels 46.

In this cage embodiment, the cage surfaces contacting the rollers 50 may conform to the rollers contours in a type of scalloped shape 65 as shown in FIG. 6. The dimensions of FIG. 6 have been exaggerated for illustrative purposes. By incorporating this contoured surface 65 on one or both cage surfaces, less wear and friction will occur between the cage surface and the rollers during sliding contact.

Another embodiment of the cages may restrain only the azimuthal location of the rollers, with both the radial and axial restraint provided by the rear wall 49 and front lips 48*a*, 48*b* of the linear channels 46. Such an embodiment could use a similar cage design to that shown in FIG. 6, with only a slight modification to the translation channels lips to provide a "seal" for the rollers ends so that the rollers are constrained radially as well as axially. Such a seat would be analogous to that provided by a conventional draw cup needle roller bearing cup, restraining the rollers radially and axially within this seat.

It is understood that many different cage and linear channel designs are possible for the rolling interface within the scope of the present invention. In combination, all share the features of providing proper roller position and ensuring a rolling interface between at least one vane tab surface and at least one linear channel surface.

As described previously, with the cage 52' disposed in the linear channel 46, the vane tab 35 may interface with a rear wall 64 of the cage 52' to retain the cages 52' axially. Also, axial walls may extend from each side of the cage 52', to which the vane tabs 35 may interface. This axial-wall interface maintains the cage, and thus the rollers 50 retained by the cage, in a proper position of support for the vane tab 35, preventing the rollers 50 from aggregating away from a supporting position. If the rollers 50 aggregated away from the vane tab 35 within the linear channel 46, then the vane tab 35 would no longer have a rolling interface between it and the corresponding wall of the linear channel 46, giving rise to an unwanted condition of high friction and high radial play. Thus, the cages 52' in this illustrated embodiment participate with the vane tabs 35 and linear channel wall shapes to not only restrain the rollers 50 against their bearing surfaces, but also maintain their proper position of support against the vane tab surfaces 36*a* and 36*b*.

Even if cages are not employed, the rollers 50 may still be retained axially and radially by the upper and lower extending lip portions 48*a* and 48*b* if these lips conformed around the roller ends with a seat to provide radial restraint. Without cages 52, however, means would have to be provided to maintain proper alignment of the rollers 50 along the direction of linear motion within the linear channels, so that the rollers 50 did not aggregate entirely away from supporting the vane tab 35.

The linear channels 46 and vane tab surfaces 36*a,* 36*b* need not be perfectly linear, but any slight contour or non-linearity should not interfere with the geometrical constraint between the vane tabs 35 in their linear channels 46, the vanes 24 in their rotor slots 25, the rotor 22 around its shaft 21 axis, and the translation rings 40 around its axis 42. A slight contour to the tab and/or channel surface might provide improved bearing load distribution and/or stability for the mechanism for certain applications and/or embodiments, as would be apparent to one skilled in the arts of rolling bearings and rotational machinery.

The radial motion of the vanes is controlled by the linear translation ring geometry. Utilizing rolling bearing interfaces in this geometry enhances the performance of the machine, though sliding interfaces may be adequate in some applications. However, within the practice of the present invention, it may also be desirable to control the axial location of the vanes or to center the vanes axially so that they do not contact the end walls of the chamber or to minimize such contact.

One means of producing such axial alignment is to provide tapers 34*c* on the sides of the vanes, as shown in FIG. 3C. The angle of the taper is exaggerated for illustrative purposes. These tapers 34*c* produce a fluid-dynamic wedge or hydrodynamic lubrication using air or the pumping fluid as the fluid that will prevent or minimize contact between the vanes 24 and the end walls of the chamber. All surfaces should be as smooth as possible. The tapers 34*c* should be as shallow as is practical to machine, usually of a steeper gradient than the surface roughness peak-to-valley average value. The advantages of this means of providing axial centering include the low fabrication cost, lack of additional features, and simplicity of assembly.

The tapers 34*c* on the vane sides can be uni-directional as illustrated in FIG. 3C. With the uni-directional tapers, the vanes must be aligned properly within their slots so that the wedge "skis" in the direction of rotor rotation R. Note that the taper 34*c* increases from the rear face 92 of the vane 24 to the front face 91 in the direction of rotor rotation R.

Figure 3F:
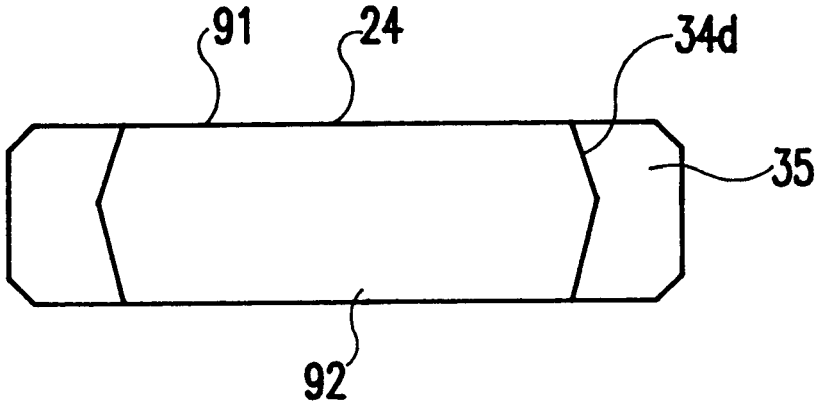
FIGS. 3C, 3D, 3E, 3F and 3G are top, front and side views of alternate embodiments of shapes for the vane and the vane protruding tabs.
Figure 3C:
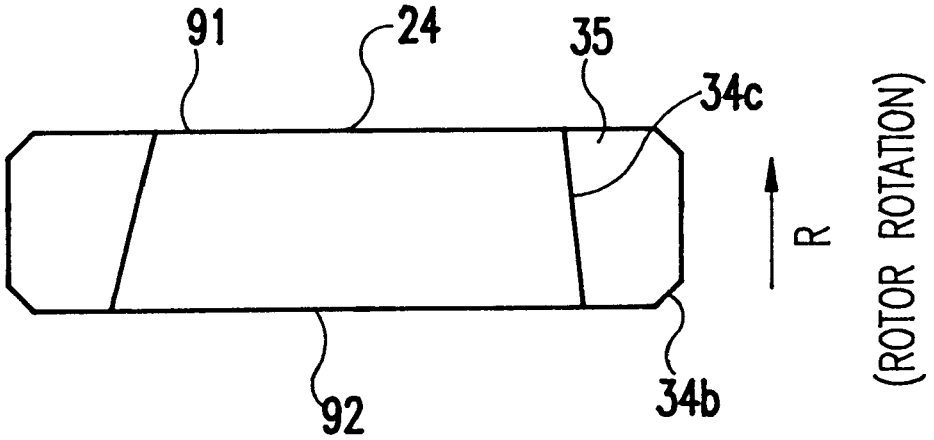
Figure 3G:
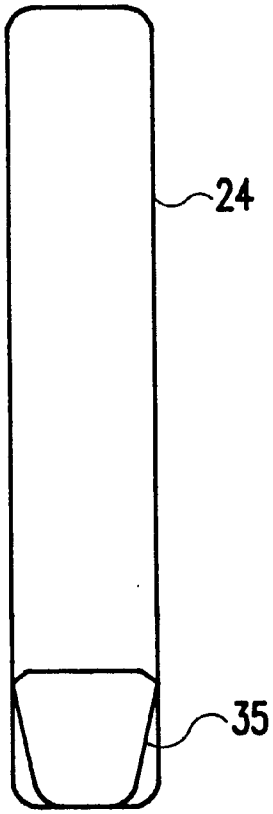
Figure 3E:
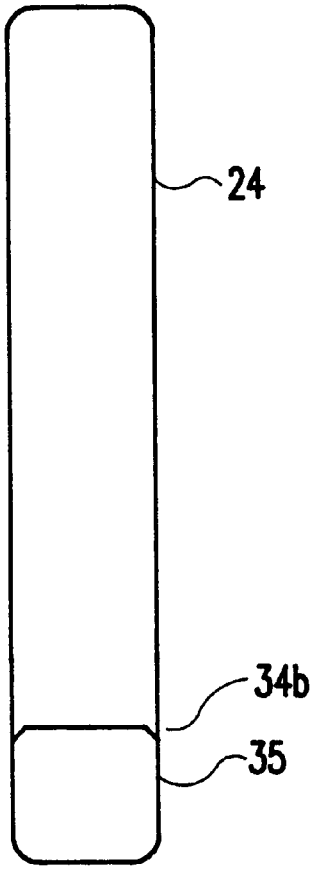
Figure 3D:
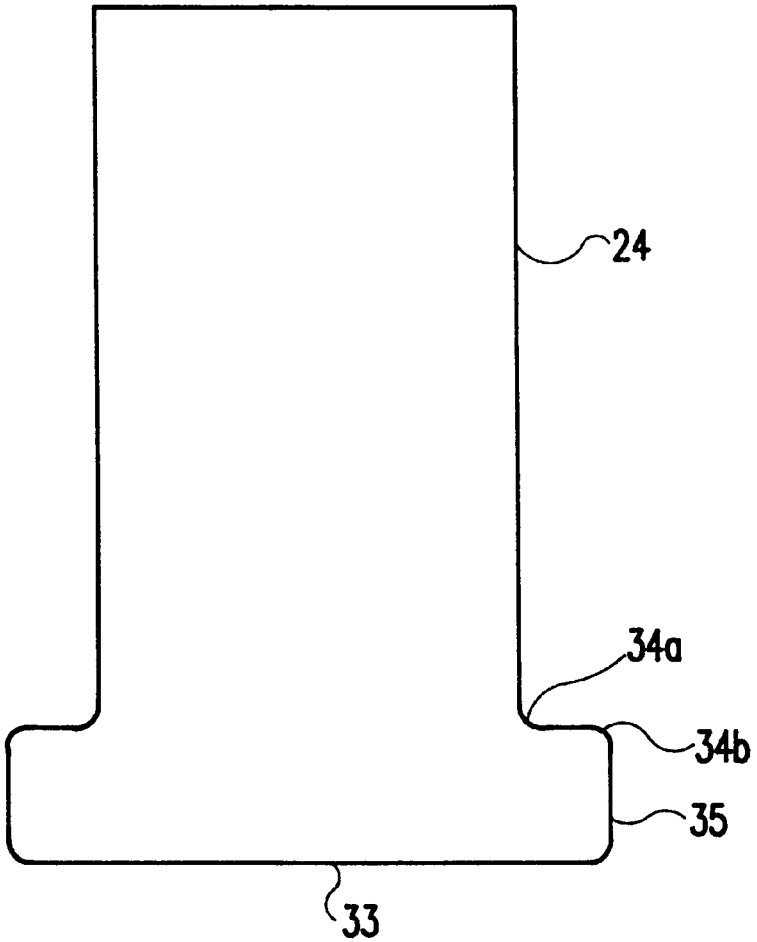

Alternatively, bi-directional tapers 34*d* may be employed as shown in FIG. 3F. Note that the taper 34*d* increases towards each of the front 91 and rear 92 faces of the vane 24. With the bi-directional taper, no directional alignment of the vanes is required, simplifying assembly, though the maximum practical centering forces are reduced compared with the uni-directional tapers 34*c*.

Figure 8A:
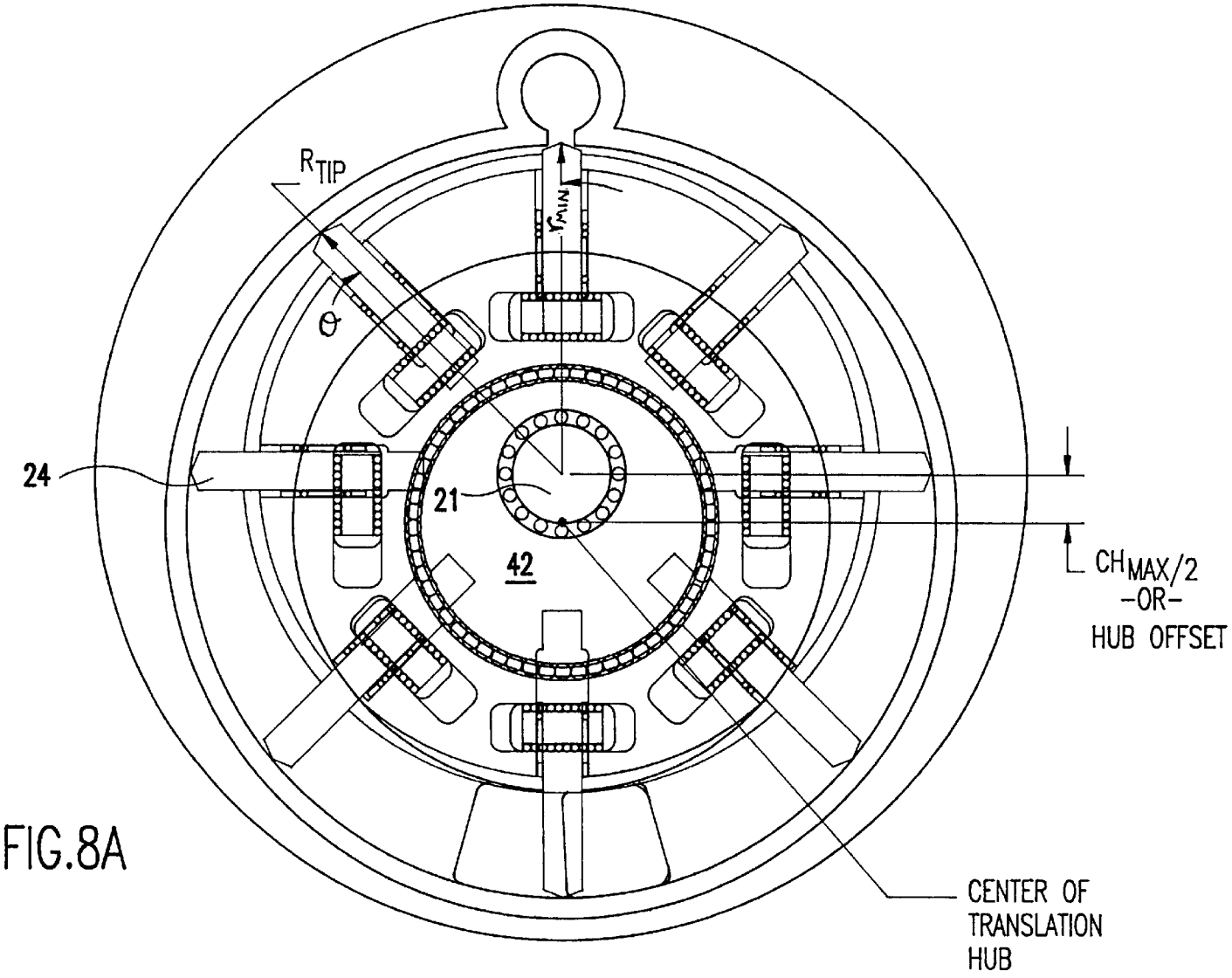
FIG. 8A is a side cross sectional view of a rotary-vane machine in accordance with the present invention showing the mathematical relationship associated with the path the vane tips trace within the contoured stator cavity.
Figure 8B:
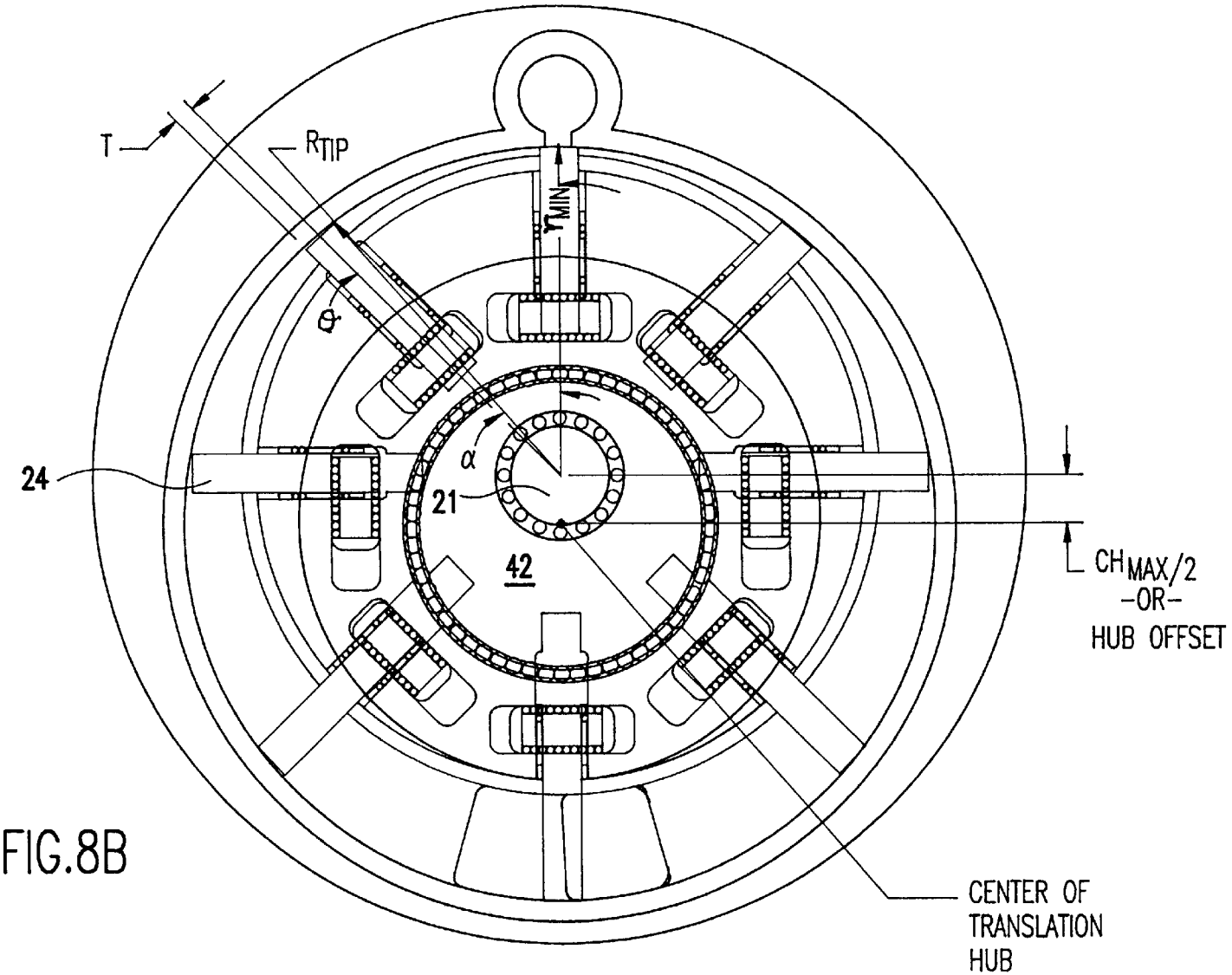
FIG. 8B is a side cross sectional view of a rotary-vane machine in accordance with the present invention showing the mathematical relationship associated with the path the square vane tips trace within the contoured stator cavity.

As described previously, the rotation of the rotor 22 automatically sets the radial position of the vanes at any rotor angle, producing a single contoured path as traced by the vane tips (31*a* or 31*b*) resulting in a unique stator cavity 26 shape that mimics the path the vane tips trace. FIGS. 8A and 8B are side cross sectional views of a rotary-vane pumping machine in accordance with the present invention showing the components of the mathematical relationship associated with the contoured stator cavity.

For a triangular shaped sharp vane tip, such as shown by reference numeral 31*b* in FIG. 3B, the polar coordinates (radius and angle) of the vane tip path contour are in accordance with the following equation (1), with reference to FIG. 8A:

$$R_{tip} = r_{\min} + \frac{CH_{\max}}{2}[1 - \cos(\theta)]$$

where the contour radius $R_{tip}$ is the vane radius from the rotor shaft 21 axis to the tip of the vane 24, $r_{min}$ is the minimum tip radius along a vane radial which would intersect the translation ring axis if extended, $C_{max}$ is the maximum vane radius minus the minimum vane radius. $CH_{max}$ equals twice the translation ring hub axis 42 offset from the rotor shaft 21 axis, and θ is the rotor angle to the given vane centerline. The radius at the tip of the triangular shaped vane thus equals the minimum contour radius (which is roughly equal to the rotor radius) plus one-half (½) the hub offset multiplied by (1- cosine (θ)). The polar coordinates for the vane tip path are thus ($R_{tip}$, θ). The chamber contour will follow this path, though with some additional slight sealing gap optionally added.

As used herein, the continuous path traced by the vane tips refers to the radial path traced by the active vane sealing tips as they sweep by the stator contour. Likewise, as used herein, the contoured sealing profile of the stator chamber cavity is determined by the continuous path the vane tips trace, meaning that the path the active vane sealing tips trace describes the path of minimum possible radius from the rotor's axis to the contoured profile of the stator chamber cavity, and that additional radial clearance may be provided to this path for vane tip sealing clearance.

The above equation of motion also describes the vane path of any shape of vane tip operating within the described translation geometry of the illustrated embodiment Used for this purpose, $R_{tip}$ would reference a point fixed on the center end of the vane.

For example, for a rectangular shaped sharp vane tip, such as shown by reference numeral 31*a* in FIG. 3A, or any shape having two symmetrical sharp edges, equation (1) is modified to account for the two tips to trace the sealing path of the appropriate sealing tip. Accordingly, with reference to FIG. 8B, the polar coordinates (radius and angle) of the vane sealing tip path contour are in accordance with the following equations:

$$R_{tip} = \sqrt{\left[r_{\min} + \frac{CH_{\max}}{2}[1 - \cos(\theta)]\right]^2 + T^2}$$

$$(\text{FOR } \theta \le 180),\ \alpha = \theta - \operatorname{atan}\left(\frac{T}{r_{\min} + \frac{CH_{\max}}{2}(1 - \cos(\theta))}\right)$$

$$(\text{FOR } \theta \ge 180),\ \alpha = \theta + \operatorname{atan}\left(\frac{T}{r_{\min} + \frac{CH_{\max}}{2}(1 - \cos(\theta))}\right)$$

where T is the width from vane radial centerline to the tip edge and α is the angle to the polar coordinate of the vane tip. Notice that in the case of the rectangular vane end, the tip actually sealing the vane in effect rocks back and forth from one tip to the other depending on which side of the revolution the vane radiates. Thus, the equation for the polar coordinate angle a depends on whether the angle θ is greater than 180 degrees or less than 180 degrees. At 180 degrees both tips would in this case be sealing tips. The polar coordinates for the vane tip path are thus ($R_{tip}$, α). These equations assume the sealing tips are equidistant about the radial centerline of the vane to the rotor axis, though other asymmetrical arrangements would be possible.

Depending on the vane tip shape and other parameters, there are an infinite number of stator cavity contours 36 that may be realized to seal the path the vane sealing tips trace within the illustrated embodiment. All, however, incorporate as a component the same basic relationship as equation (1), where the radius at the imaginary center tip of the vane would equal the minimum contour radius plus ½ the maximum chamber height multiplied by (1-cosine (θ)). The radius at other actual sealing tips could thus be readily deduced from this calculated center tip's position. The vane sealing tips need not be sharp, but may be radiused or contoured for greater integrity, with the stator contour's shape modified in accordance with any sealing tip geometry.

Note that different gaps may be employed between the sealing tips of the vanes and the stator cavity contour 26, and these gaps may even change as the vane rotates through the cycle. Thus, a smaller gap may be employed at higher compression regions to reduce leakage and a larger gap may be employed at the lower compression regions where the vanes are more extended to allow for a tolerance for bearing play, cage movement, and the like.

Figure 9:
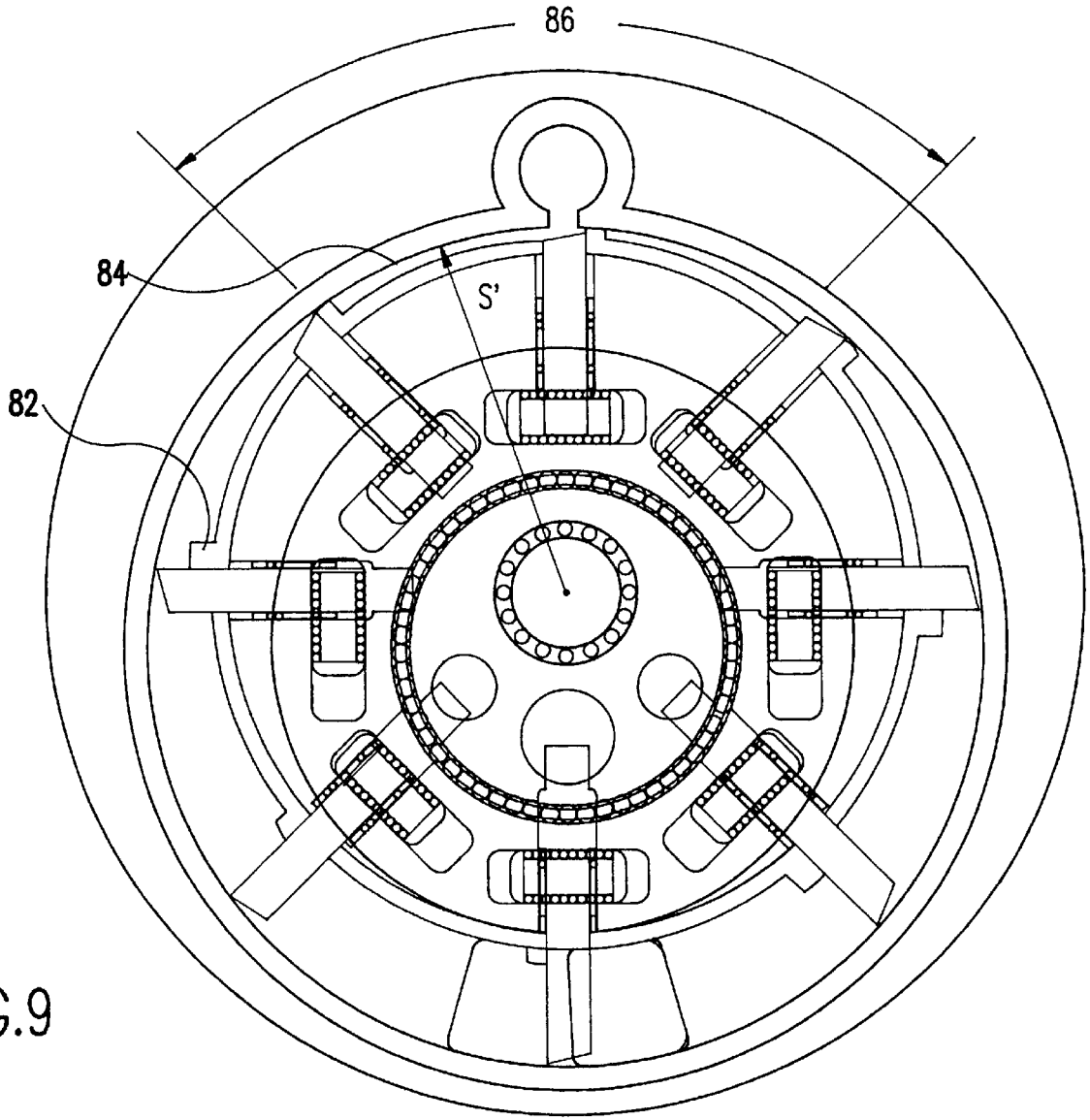
FIG. 9 is a side cross sectional view illustrating a modified stator cavity contour.

An alternative embodiment may add a feature wherein the rotor provides the sealing at the minimum volume region, as illustrated in FIG. 9. In this embodiment, one or more rotor seal-tabs 82, adjacent each vane 24, seal against a minimum-volume arcuate contour within the stator cavity, while the vane tips continue to retract and extend along the path determined by the linear translation geometry of the present invention. In this embodiment, the stator cavity contour is modified by the arcuate contour 84 within minimum volume region 86, as shown in FIG. 9.

This modification to the contour reduces the radius of the minimum volume region 86 from the rotor shaft 21 axis. For example, referring to FIGS. 1 and 9, the radius, S, of the initial stator cavity contour in FIG. 1 is greater than the indicated radius, S', at the point shown in FIG. 9. The radius of all the points in the minimum volume region 86 of FIG. 9 will be less than the corresponding point in FIG. 1.

Such an embodiment may provide tighter sealing with less chance for bearing play at the highest compression region of the cycle where sealing is most critical. Such an embodiment may also provide for higher compression ratios to be achieved with fewer vanes. The volumetric efficiency of such an embodiment is reduced somewhat, however.

The fundamental vane path traced from equation (1) produces a unique path which offers additional possible advantages to a sliding vane mechanism. Certain alternative geometrical permutations can take advantage of this path to not only provide radial vane guidance but also provide a means wherein opposing vanes are tied via a connecting means, in order to reduce the inertial load on the guidance mechanism and thereby increase longevity and/or the maximum rotational speed of the machine.

A beneficial feature of this path of equation (1) is that the distance between diametrically-opposed vanes (i.e., those vanes 24 spaced 180 degrees apart with reference to the rotor rotational axis), is constant as the vanes rotate with the rotor within their contour. A constant-length connecting means, which connects one pair of opposing vanes 24, is shown by the dashed line 90 in FIG. 1. All diametrically-opposed vanes may be likewise connected, provided the connecting means 90 are offset axially so that they do not interfere with each other. A simple strip of metal or other suitable material may be employed as the connecting means 90, and this strip may pass through the rotor or at the axial ends of the rotor. Because the centripetal inertial loads of the opposing vanes offset each other to a significant degree, the force required to guide each vane pair is significantly reduced. One or more connecting means may be employed for each opposing vane pair, and the connecting means may provide net restraint to the vanes at their center of gravity axial position or at an offset, asymmetrical axial position.

By employing this embodiment of tying opposing vanes following the path of equation (1), within the linear translation embodiment, certain beneficial features and effects may be obtained. The vane tabs on each vane need only be guided by the outer or the inner surface because the diametrically-opposed and tied vane tab will provide restraint in the direction opposite the guiding surface. If roller bearings need only be provided for one vane surface, a cage affixed to the vane tab may be employed incorporating a means for recirculating these rollers around the vane tab, thereby eliminating the need for the reciprocating cages within the translation channels. Sleeve or follower bearings may also be employed with the tied vane geometry while maintaining automatic translation-ring alignment. As an example of this tied-vane geometry, with six diametrically opposed vanes utilizing inner tab bearing surfaces only, the linear translation ring and channels could take the form of a hexagon, with the six outer flat surfaces of the hexagon being the channel surfaces against which the inner tab surfaces communicate via a rolling or sliding interface. The means for connecting the diametrically-opposed vanes may be pre-tensioned and/or made of a stiff material to minimize the stretching effects at high rotational speeds.

In addition, with the tied-vane geometry, springs 92 of any type may be added within the rotor slots to offset or reduce the forces from combustion or chamber pressures acting on the vanes. These rotor-slot springs 92 may also reduce the inertial loads that the vane tabs must counter with the tied-vane geometry. The rotor-slot springs 92 may be compression or expansion springs, depending on the application. If compression springs are employed, the springs need not contact the vanes during their entire range of motion, but may be used to provide a counter-force only during the minimum volume regions or when the vanes are retracted within their rotor slots. Such compression springs may also be employed in an embodiment not employing tied vanes to reduce the high fluid-pressure forces acting on the vane tabs.

Referring again to FIG. 1, a residence chamber 60 may be provided, for example, in an internal combustion engine application. The residence chamber 60 is a cavity or series of cavities within the stator 26, radially and/or axially disposed from the vane cell 29, which communicates with the air or fuel-air charge at about peak compression in the machine. The residence chamber 60 may create an extended region in communication the residence chamber in the machine. The residence chamber 60 may be of variable volume.

The particular parameters of such an extended region (e.g., the compression ratio, vane rotor angle, number of vanes, residence chamber position and volume) may vary considerably within the practice of this invention. What is important in an internal combustion engine application is that there can be a sufficient duration to the combustion region so that there is adequate time to permit near-complete combustion of the fuel. The combustion residence chamber, by retaining a hot combusted charge in its volume, permits very lean mixtures to be combusted. This characteristic permits very low pollution level to be achieved, as more fully described in U.S. Pat. No. 5,524,586.

When the present invention is utilized with internal combustion engines, one or more fuel injecting devices 70 may be used and may be placed on one or both axial ends of the chamber and/or on the outer or inner circumference to the chamber. Each injector 70 may be placed at any position and angle chosen to facilitate equal distribution within the cell or vortices while preventing fuel from escaping into the exhaust stream. The injector(s) 70 may alternatively be placed in the intake port air flow as more fully described in U.S. Pat. No. 5,524,586.

The illustrated internal combustion engine embodiment employs a two-stroke cycle to maximize the power-to-weight and power-to-size ratios of the engine. The intake of the fresh air I and the scavenging of the exhaust E occur at the region 80, the scavenging region of the engine cycle. One complete engine cycle occurs for each revolution of the rotor 22.

The present invention may also apply to a vane machine where the relative motion of rotor and stator are maintained, but where the "stator" actually rotates and the "rotor" is actually fixed, or where both rotate in opposite relative motion. Even the linear translation rings could be held fixed and the "rotor" and "stator" could rotate and orbit to provide the same relative motion. What is important in any embodiment is that the relative motion between the vanes, the vane housing ("rotor"), the casing and end plates (together the "stator"), and the translation ring(s) be maintained as described within the present invention.

As used herein, "fixed" refers to a reference which is fixed in relation to the "stator". Likewise, as used herein, motion terms such as "rotate", "rotates", "rotating", "rotation", "rotational", "spins", "spinning", and "sweep" refer to relative motions viewed from the reference frame of the "stator". In all cases, the absolute motion of the "stator" is not relevant to defining the relative motions.

This invention increases the maximum rotor speed (and thus flow-rate) possible within a given sized machine, while reducing friction and complexity to maintain a high flow-rate, and eliminating the need for exposed chamber lubricant. This invention would apply to all rotary-vane or sliding-vane pumps, compressors, engines, vacuum-pumps, blowers, and internal combustion engines. Intake and/or exhaust ports may be provided at many different location around the chamber depending upon the desired operation of the machine. Anyone skilled in the art of vane machines could determine the best location for such ports, within the context of the present invention.

The present invention design has many advantages. The radial-guidance mechanism permits higher loads at higher rotor rotational speeds to be sustained by the bearing surfaces than with conventional designs. Much higher flow rates are thus achieved within a given size pumping device or internal combustion engine, thereby improving the performance and usefulness of these machines. Such a means for radial-guidance also permits a near-circular chamber contour in order to maintain low manufacturing costs. Such an improved frictional interface should furthermore guide the vanes at a location removed from the chamber surfaces of the device, in order that lubrication within the flow path might be minimized for pollution and other reasons. The radial-guidance means should permit the vane sealing tips to be guided with high precision at a small gap from the chamber contour, to maximize sealing efficiency yet minimize or eliminate sliding frictional contact within the chamber. Such an improved geometry should maintain the desirable steady-state characteristic of the chamber surface with the vanes sweeping around within a chamber contour as described above.

Optimization techniques known in the art of structural optimization, finite element analysis, and/or mechanical engineering, may be applied to any or all of the components described in the present invention to modify the shapes of these components for the purpose of reducing weight and/or optimizing the stiffness characteristics or load distribution, provided such modified shapes work in accordance with the geometrical and other constraints described and defined within the spirit and scope of the present invention.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

I claim:

1. A rotary vane machine having a stator cavity communicating with a rotor, said rotor spinning around a rotor shaft axis which is a fixed rotational axis relative to said stator cavity, comprising:

a plurality of vanes disposed in a corresponding plurality of vane slots in said rotor, each of said vanes having a tip portion and a base portion, said base portion having at least one protruding tab extending from at least one axial end therefrom;

a means for vane guidance comprising a translation ring disposed at one axial end of the machine corresponding to the end of said protruding tabs, said translation ring rotating around a fixed hub located within an end plate of the machine, said fixed hub being eccentric to the rotor shaft axis; and a plurality of linear channels formed in said translation ring, wherein the at least one protruding tab extending from the base portion of each of the plurality of vanes communicates with a respective linear channel in the translation ring, whereby the rotor rotation causes rotation of the vanes and a corresponding rotation of the translation ring;

said stator cavity having a contoured sealing profile determined by a continuous path traced by the tips of the vanes as the rotor spins around the rotor shaft axis and the translation ring rotates around the eccentric fixed hub, thereby creating cascading cells of at least one of compression and expansion, between said rotor, said vanes, and said stator cavity as said vanes sweep by said contoured profile of said stator cavity.

2. The rotary machine of claim 1, wherein the translation ring and the rotor rotate at the same angular velocity.

3. The rotary machine of claim 2, further comprising a plurality of rollers arranged in said linear channels, said rollers communicating with at least one of upper and lower flat surfaces of said protruding tab, said plurality of rollers being disposed between the respective upper and lower surface of the protruding tab and upper and lower walls of the linear channel.

4. The rotary machine of claim 3, further comprising a means for restraining said rollers in said linear channel.

5. The rotary machine of claim 4, wherein each of said linear channels comprises at least one of an upper and lower extending lip portion at an axial interface with the rollers for retaining the rollers within the linear channels.

6. The rotary machine of claim 5, wherein each of said linear channels comprises a rear wall at an axial interface with the rollers for retaining the rollers within the linear channels.

7. The rotary machine of claim 4, wherein said means for restraining includes a respective plurality of roller cages, each cage arranged within each of the plurality of linear channels to house said plurality of rollers.

8. The rotary machine of claim 7, each of said cages further comprising a rear wall, whereby an end of said protruding tab communicates with said rear wall for retaining the cages within the linear channels.

9. The rotary machine of claim 8, each of said cages further comprising a protruding wall extending from each side of the real wall of said cage, whereby the linear motion of said cage is bounded by the protruding tab within the linear channels.

10. The rotary machine of claim 3, wherein a junction between said base portion of said vane and said protruding tab extending therefrom is substantially orthogonal.

11. The rotary machine of claim 10, wherein said protruding tab is trapezoidal-shaped, whereby a width of the lower surface of the protruding tab is less than a width of the upper surface.

12. The rotary machine of claim 1, wherein the tips of said vanes are rectangular shaped.

13. The rotary machine of claim 1, wherein the tips of said vanes are radiused or contoured.

14. The rotary machine of claim 1, wherein the tips of said vanes are triangular shaped.

15. The rotary machine of claim 3, wherein each of said plurality of rollers is spherical.

16. The rotary machine of claim 3, wherein each of said plurality of rollers is cylindrical, and a length of the cylindrical roller is at least the same as a length of said flat surface of said protruding tab.

17. The rotary machine of claim 3, wherein each of said plurality of rollers is cylindrical, and a length of the cylindrical roller is approximately the same as an axial width of said linear channels.

18. The rotary machine of claim 1, wherein sides of said vanes are tapered.

19. The rotary machine of claim 18, wherein said side taper is unidirectional and increases in the direction of rotor rotation.

20. The rotary machine of claim 18, wherein said side taper is bi-directional, said taper increasing towards each of a front face and a rear face of the vane.

21. The rotary machine of claim 1, wherein the continuous path traced by the vane tips is determined in accordance with the equation, $$R_{tip} = r_{\min} + \frac{CH_{\max}}{2}[1 - \cos(\theta)]$$

where contour radius $R_{tip}$ is a vane radius from the rotor axis to a center tip of the vane, $r_{min}$ is a minimum tip radius, $CH_{max}$ is a maximum vane radius minus the minimum vane radius, which $CH_{max}$ equals twice a hub offset, and θ is a rotor angle.

22. The rotary machine of claim 1, wherein the continuous path traced by the vane tips is determined in accordance with the equation, $$R_{tip} = \sqrt{\left[r_{\min} + \frac{CH_{\max}}{2}[1 - \cos(\theta)]\right]^2 + T^2}$$

$$(\text{FOR } \theta \le 180),\ \alpha = \theta - \operatorname{atan}\left(\frac{T}{r_{\min} + \frac{CH_{\max}}{2}(1 - \cos(\theta))}\right)$$

-continued $$(\text{FOR } \theta \ge 180),\ \alpha = \theta + \operatorname{atan}\left(\frac{T}{r_{\min} + \frac{CH_{\max}}{2}(1 - \cos(\theta))}\right)$$

where contour radius $R_{tip}$ is a vane radius from the rotor axis to a sealing tip of the vane, $r_{min}$ is a minimum tip radius, $CH_{max}$ is a maximum vane radius minus the minimum vane radius which $CH_{max}$ equals twice a hub offset, θ is a rotor angle, and T is a width from a radial centerline of the vane to an edge of the tip portion, and α is an angle to a polar coordinate of the vane sealing tip.

23. The rotary machine of claim 2, further comprising a residence chamber in said stator cavity communicating with said cells.

24. The rotary machine of claim 2, further comprising fixed intake and exhaust ports communicating with the said cells at an intake and exhaust region of the machine.

25. The rotary machine of claim 23, further comprising fuel injection means and combustion means.

26. The rotary machine of claim 3, wherein the vane to rotor slot interface and the tab to linear channel interface are both rolling interfaces.

27. The rotary machine of claim 1, further comprising another translation ring located at another axial end of the machine.

28. The rotary machine of claim 1, wherein a radius from the rotor axis to the stator cavity contoured sealing profile is reduced over a finite arcuate portion of said contoured sealing profile to provide a minimum volume region.

29. The rotary machine of claim 28, further comprising at least one rotor sealing tab adjacent each of said vanes, said at least one rotor sealing tab providing sealing against the stator cavity along said finite arcuate portion.

30. The rotary machine of claim 1, further comprising a connecting means for connecting respective of the base portions of two of the plurality of vanes that are diametrically-opposed or 180 degrees apart as measured by the rotor axis rotation.

31. The rotary machine of claim 30, further comprising a spring housed within the rotor slots communicating with the respective base portions of the diametrically-opposed vanes.

32. The rotary machine of claim 1, further comprising a spring housed within the rotor slots communicating with the base portions of the vanes.

33. The rotary machine of claim 1, wherein an axis of rotation of said translation ring is offset a predetermined distance from said rotor shaft axis, and wherein said predetermined distance is equal to one-half a maximum reciprocation range of said vanes.

34. The rotary machine of claim 2, wherein each of said linear channels comprises a rear wall as a means to stiffen said translation ring.

35. A rotary vane machine having a stator cavity communicating with a rotor, said rotor spinning around a rotor shaft axis which is a fixed rotational axis relative to said stator cavity, comprising:

a plurality of vanes disposed in a corresponding plurality of vane slots in said rotor, each of said vanes having a tip portion;

a continuous path traced by the vane tips determined in accordance with the equation, $$R_{tip} = r_{\min} + \frac{CH_{\max}}{2}[1 - \cos(\theta)]$$

where contour radius $R_{tip}$ is a vane radius from the rotor axis to a center tip of the vane, $r_{min}$ is a minimum tip radius, $CH_{max}$ is a maximum tip radius minus the minimum tip radius, and θ is a rotor angle;

said stator cavity having a contoured sealing profile determined from a continuous path traced by the tips of the vanes as the rotor spins around the rotor shaft axis, thereby creating cascading cells of at least one of compression and expansion, between said rotor, said vanes, and said stator cavity as said vanes sweep by said contoured profile of said stator cavity.

36. The rotary machine of claim 35, further comprising a connecting means for connecting respective of the base portions of two of the plurality of vanes that are 180 degrees apart as measured by the rotor axis rotation.

* * * * *